US005531517A

United States Patent [19]

Alpen

[11] Patent Number: 5,531,517

[45] Date of Patent: Jul. 2, 1996

[54] INTERLOCKING FRONT-LOAD BULK STORAGE CONTAINERS

[76] Inventor: Richard Alpen, R.R. #2, Site 35 - Comp. 22, Penticton, British Columbia, Canada, V2A 6J7

[21] Appl. No.: 119,001

[22] Filed: Sep. 9, 1993

[30] Foreign Application Priority Data

Jul. 22, 1993 [CA] Canada ..... 2101139

[51] Int. Cl.[6] ..... F16B 12/00

[52] U.S. Cl. ..... 312/111

[58] Field of Search ..... 312/107, 108, 312/111

[56] References Cited

U.S. PATENT DOCUMENTS

| | | | |
|---|---|---|---|
| 224,486 | 2/1880 | Spruce | 312/107 |
| 1,076,116 | 10/1913 | Hatfield . | |
| 1,736,651 | 11/1929 | Glaezner . | |
| 3,033,635 | 5/1962 | Glass . | |
| 3,107,131 | 10/1963 | Lightburn | 312/107 |
| 3,425,586 | 2/1969 | Petters et al. . | |
| 3,563,624 | 2/1971 | Stice | 312/111 |
| 3,836,218 | 9/1974 | Hallal . | |
| 3,851,936 | 12/1974 | Muller . | |
| 4,372,445 | 2/1983 | Keffeler . | |
| 4,817,809 | 4/1989 | Rozmestor . | |
| 4,903,451 | 2/1990 | Gresswell . | |
| 5,046,789 | 9/1991 | Lee . | |

FOREIGN PATENT DOCUMENTS

| | | | |
|---|---|---|---|
| 1255448 | 1/1961 | France | 312/107 |

OTHER PUBLICATIONS

Stanley, Merchandising Systems, updated, pp. 23–24 (No Date).

*Primary Examiner*—Timothy S. Thorpe
*Attorney, Agent, or Firm*—Bishop & Co.

[57] ABSTRACT

A front-loading interlocking modular merchandising display has a bin having front, rear and side surfaces, the front surface having an opening therein, the side and rear surfaces having at least one vertical groove on each of the surfaces, and a rail for sliding engagement within the at least one vertical groove, the rail having, in cross-section, opposed ends wider than a middle section of the cross-section, wherein each of the at least one vertical groove has a front aperture and a recessed cavity behind the aperture, the recessed cavity wider in cross-section than the front aperture, the rail for interlocking mating engagement of two of the bins when the bins are adjacent.

1 Claim, 7 Drawing Sheets

INTERLOCKING FRONT-LOAD BULK STORAGE CONTAINERS

FIELD OF THE INVENTION

The present invention relates to bulk storage containers which may be loaded from the front and which interlock so that a merchandising shelving unit may be constructed.

BACKGROUND OF THE INVENTION

Effective merchandising in hardware stores means putting as much merchandise as possible into the floor space available. Typically in a hardware store there are bins of loose nails, screws or the like. A typical example of a nail bin display is of the style having round dish-shaped bins rotatably mounted on a pole. Other examples of display containers are box-like containers manufactured by Stanley™ and sold as Stanley™ Merchandising Systems. Typically these Stanley™ bins are free-standing or possibly stackable one on top of another. Usually they are placed side-by-side on a rock and the rock mounted to a wall. These bins do not interlock when placed side-by-side. However, interlocking vertical columns may be made of such bins. The present invention makes more effective use of merchandise display space than either the rotatable circular bins or the Stanley™ bins by providing box-like containers which interlock vertically, side-to-side, and side-to-back to form a densely packed merchandising shelving unit.

The inventor is also aware of U.S. Pat. No. 3,851,936 which issued on Dec. 3, 1974 to Muller for an invention entitled Attachment Device for Modular Units. This patent teaches modular front-loading cabinets where the side walls of the modular units are configured to provide interlocking surfaces. The interlocking surfaces have wedge-shaped raised and recessed portions aligned front-to-back on the side walls of the modular units. Raised portions interlock into recessed portions correspondingly placed on adjacent units so as to interlock such units side-to-side. The modular units may also be similarly interlocked vertically. Again the wedge-shaped raised and recessed portions on the top and bottom surfaces of the units are aligned from front-to-back and lock the modular units relative to one another. The Muller system is rather inflexible in that no provision is made for mounting the modular units back-to-back or back-to-side. Thus each column or wall of such units must stand alone and cannot rely on interlocking in a back-to-back or back-to-side orientation to other such columns for added stability. The configuration of interlocking horizontally-oriented wedges further makes dis-assembly and re-assembly, so as to vary the shape or size of a particular merchandising display, quite difficult because the modular units can not be lifted straight out of the display but must be translated horizontally and then only by disassembly starting at one end of the display and working inwards removing one unit at a time.

What is required is a front-loading interlocking modular display unit which may be built up from individual front-opening modular traits into a merchandising display by interlocking columns of such units side-to-side, back-to-back, and back-to-side, such a merchandising display adapted to be disassembled in part and reassembled without the need to completely dismantle the display.

SUMMARY OF THE INVENTION

The present invention is comprised of modular box-like bins, each bin incorporating vertical channels into the side and back walls of the bins so that a plurality of such bins may be stacked and mounted adjacent in a side-to-side, back-to-back or back-to-side arrangement by sliding extruded jointer rails into the vertical channels in the bins when the channels are adjacently placed. The channels vertically align and may be placed in close proximity with vertically aligned channels in adjacent columns of bins. The vertical channels are shaped so as to accept the jointer rails in a dove-tail fit, each rail in cross-section having two opposed male dove-tail mating sections. Each of the opposed male dove-tail mating sections fit snugly, and may be slid longitudinally into, respective adjacently placed vertical channels.

Adjacent bins have corresponding vertical channels on each bin in close proximity to one another so that the jointer rails may be slid vertically into both adjacent vertical channels simultaneously, thereby fastening the adjacent bins to one another.

Similarly, in stacked columns of such modular bins, a single jointer rail may be fitted continuously and vertically through the longitudinally aligned vertical channels on each bin to secure the columnar orientation of those bins.

What constitutes the present invention comprises a bin having front, rear and side surfaces, the front surface having an opening therein, the side and rear surfaces having at least one vertical groove on each of the surfaces, and a rail for sliding engagement within at least one vertical groove, the rail having, in cross-section, opposed ends wider than a middle section of the cross-section, wherein each of the at least one vertical groove have a front aperture and a recessed cavity behind the aperture, the recessed cavity wider in cross-section than the front aperture, the rail for interlocking mating engagement of two of the bins when the bins are adjacent.

Advantageously, the recessed cavity of each of the at least one vertical groove corresponds in shape and size to the opposed ends of the rail.

In particular, the front aperture is a vertical slit, and each of the opposed ends of the rail in cross section slidingly mates within each of the recessed cavities in a dove-tail.

DETAILED DESCRIPTION OF THE PREFERRED EMBODIMENT

Figure 1:
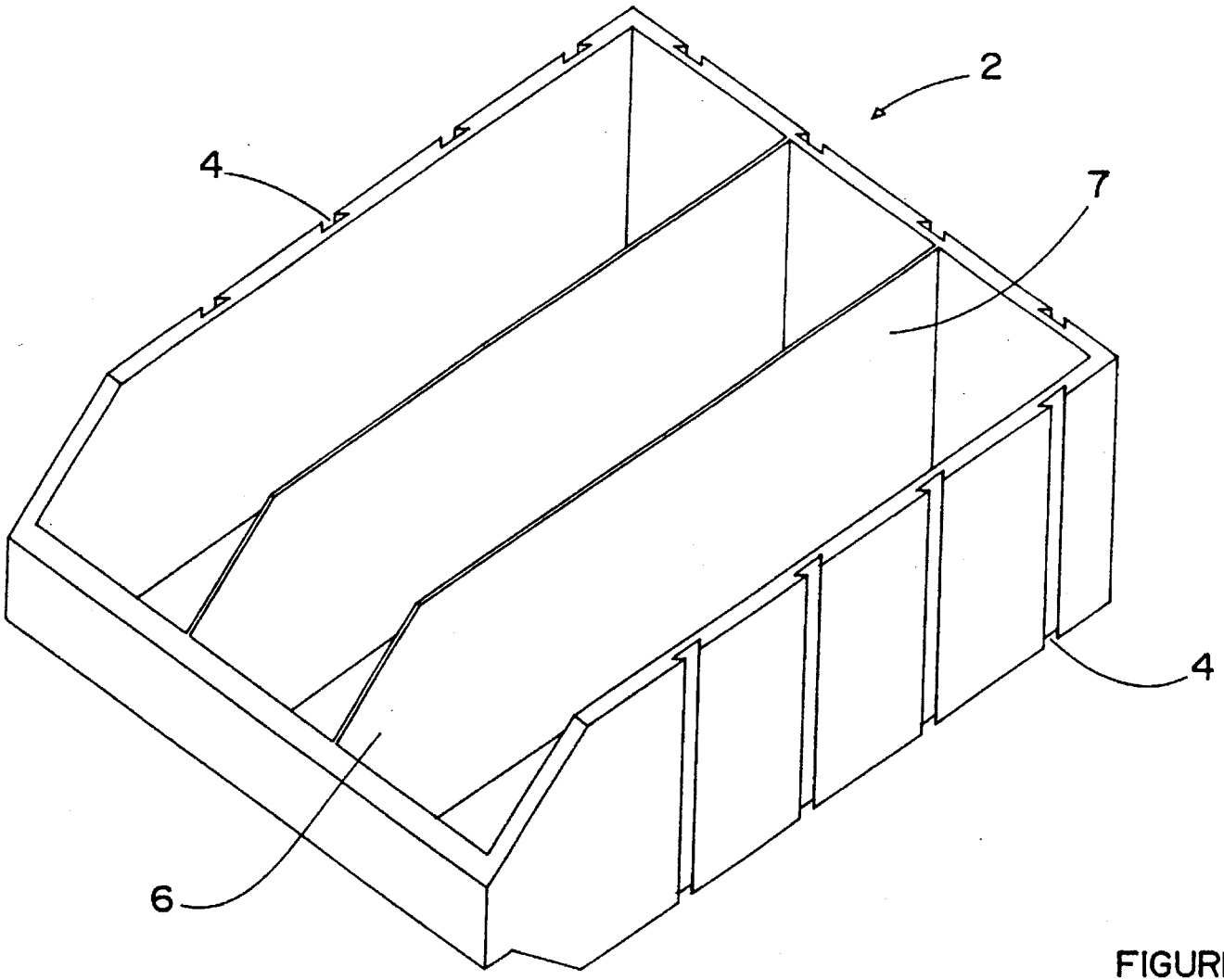
FIG. 1 is a front perspective view of a modular bin of the present invention.

FIG. 1 illustrates a typical single modular bin 2 according to the present invention. Bin 2 has vertical channels 4. Bin 2 has front opening 6 and may have one or more dividers 7.

Figure 2:
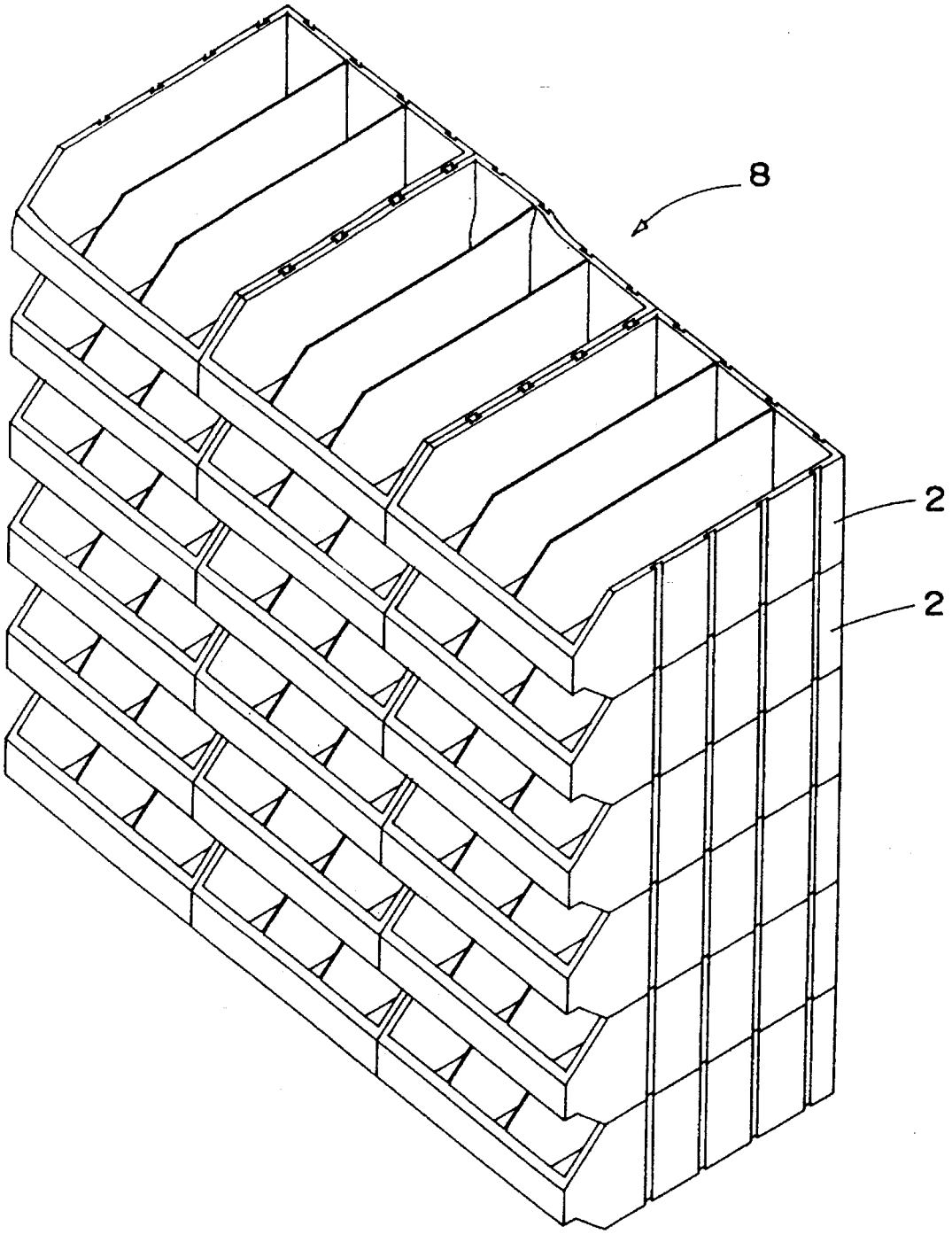
FIG. 2 is a front perspective view of a merchandising display made up of modular bins representatively illustrated in FIG. 1.

As illustrated in FIG. 2, bins 2 may be stacked vertically and columnar stacks of bins 2 may be placed and interlocked adjacent to one another so as to form a merchandising display 8.

Figure 3:
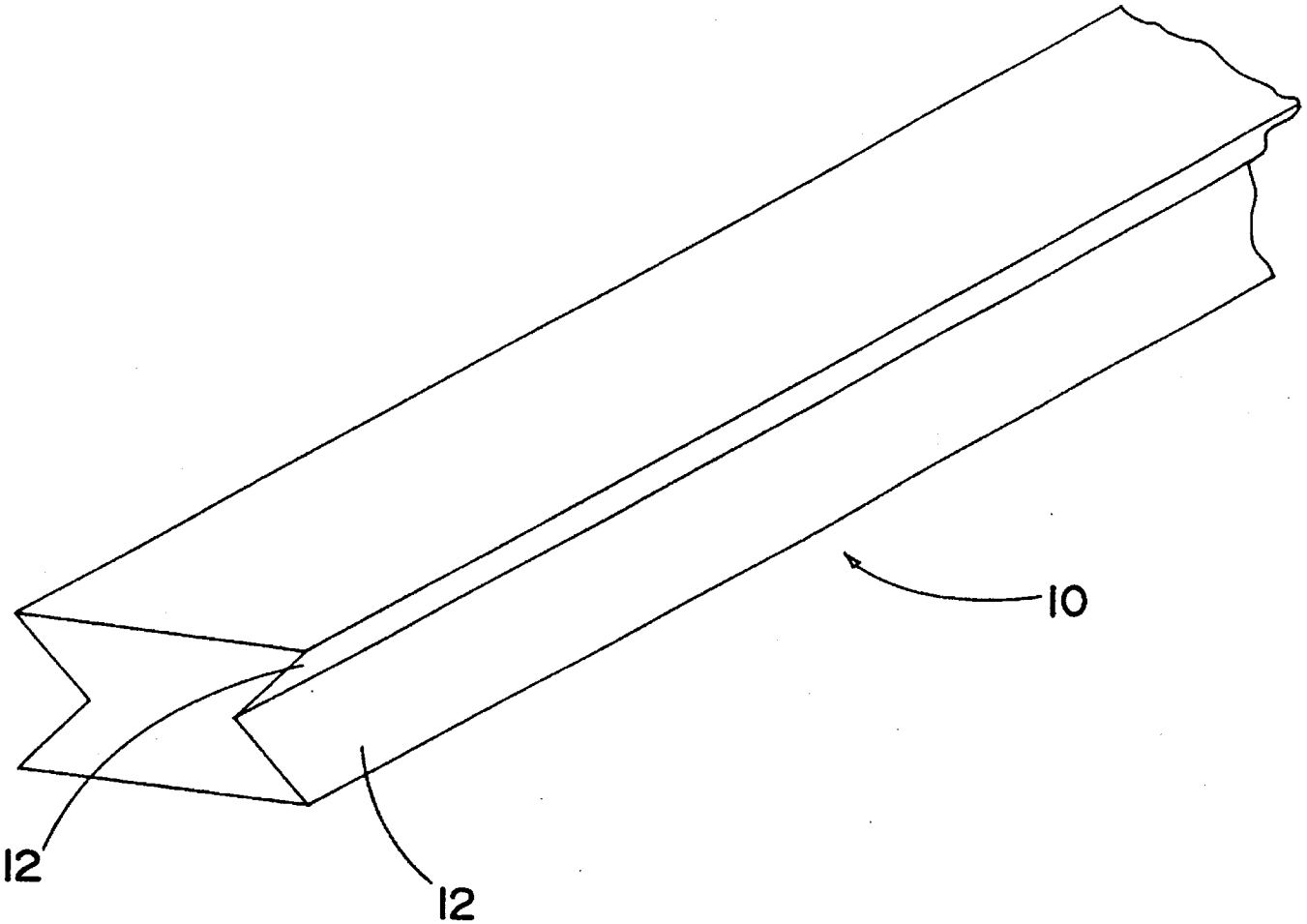
FIG. 3 is a perspective view of a jointer rail of the present invention.

Stacked and adjacent bins 2 are anchored to one another by inserting jointer rail 10, illustrated in FIG. 3, in vertical channels 4. Jointer rail 10 is comprised of opposed male mating halves 12, each male mating half 12 adapted to slide snugly into vertical channels 4 which are correspondingly dove-tail shaped.

Figure 4:
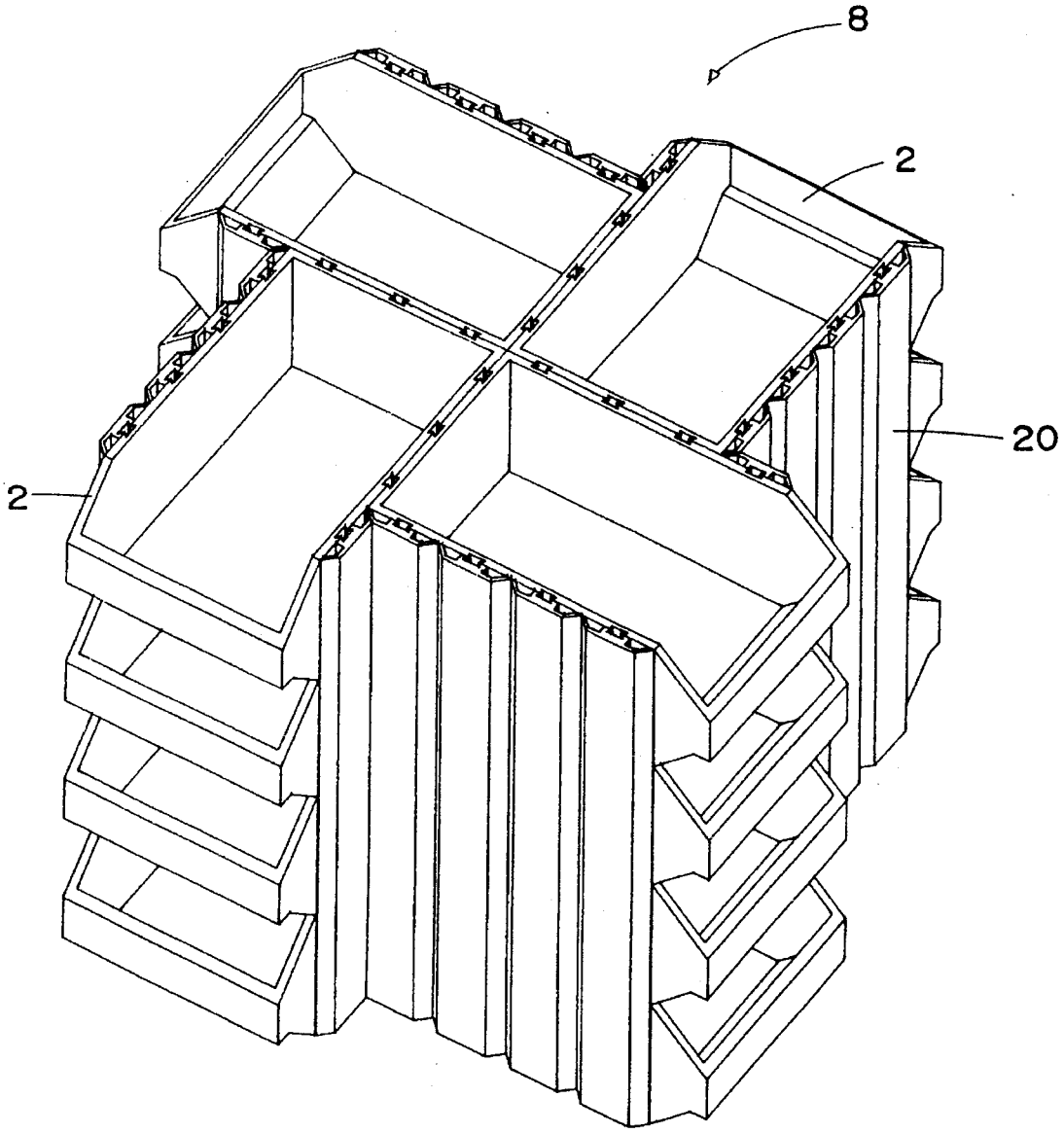
FIG. 4 is a front perspective view of a variation of the merchandising display of FIG. 2.

Vertical channels 4 are spaced equidistance apart around the side and back surfaces of bin 2 so that, as illustrated in FIG. 4, merchandising display 8 may be comprised of bins 2 mounted not only vertically and side-by-side but also back-to-back and back-to-side. Again, merchandising display 8 may be built up in this fashion using bins 2 by merely aligning the vertical channels 4 on each of bins 2 and inserting jointer rail 10 therein so that each male mating half 12 of rail 10 snugly slides into adjacent channels 4. The dove-tail shape of male mating halves 12 snugly mating into correspondingly shaped vertical channels 4 ensures that bins 2 when so mated are secured to one another laterally.

In this fashion a front-loading modular bulk storage bin display such as merchandising display 8 can be build up so as to make maximum use of display floor space. The height of the display is only limited by the structural strength of the bins themselves and the weight of stored material, the entire display 8 being given rigidity by the interlocking nature of the jointer rail 10 in vertical channels 4. Stored material may be loaded into, and removed from, bins 2 via front openings 6.

Figure 5:
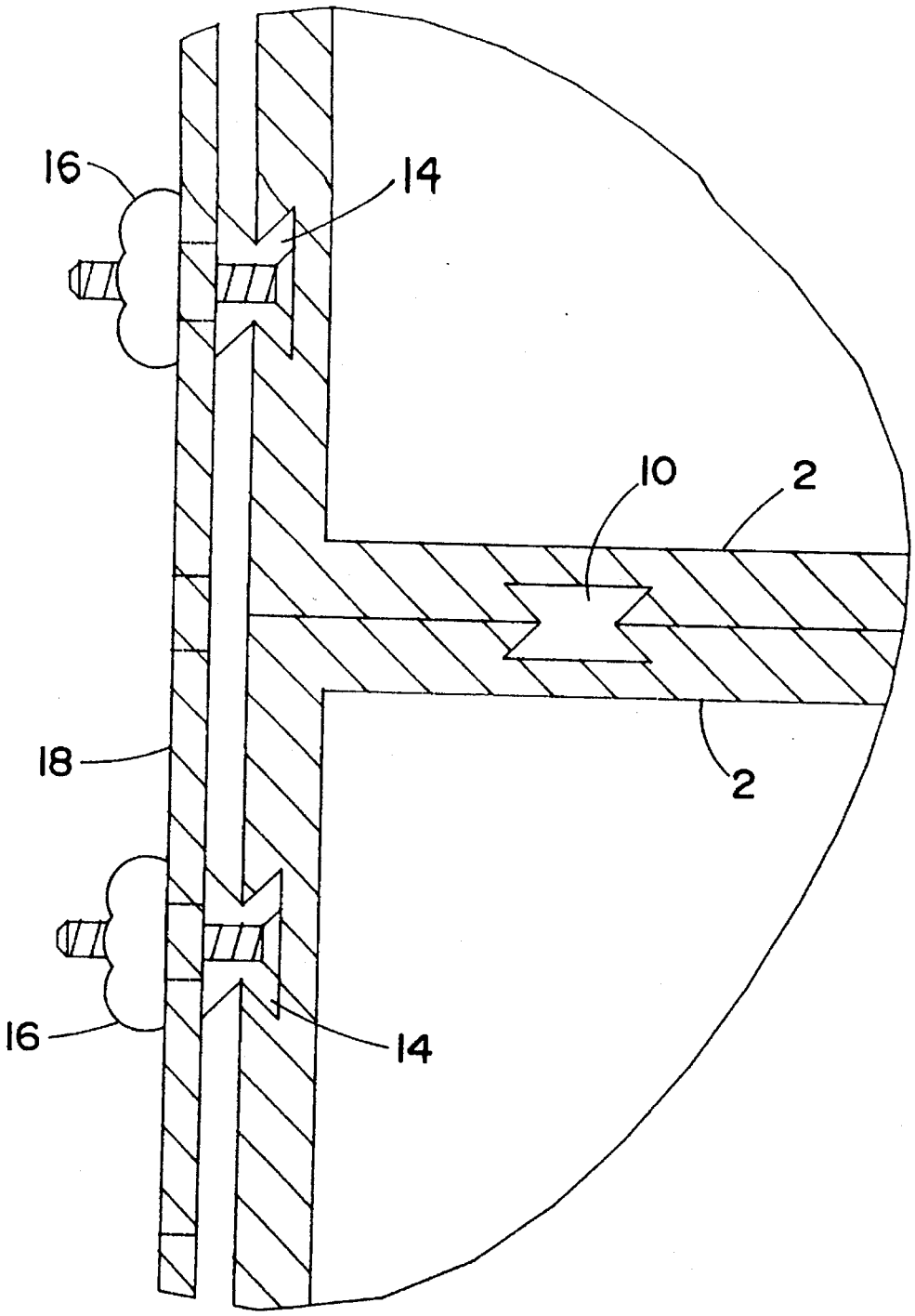
FIG. 5 illustrates, in partial plan view, two adjacent bins of the type illustrated in FIG. 1 interlocked using jointer mils of the type illustrated in FIG. 3.

Vertical channels 4 also allow for attachment to bins 2 of modified jointer rails 14, shown in cross-section in FIG. 5. Modified jointer rails 14 may be modified to incorporate anchors 16 which are designed to fasten into holes in peg-board 18 or the like or to anchor into other wall structures. Anchors 16 are pre-set into modified jointer rails 14. Modified jointer rails 14 are, in use, inserted into vertical channels 4 in the back wall of merchandising display 8, that is, the wall of display 8 adjacent a wall structure. Thus a merchandising display 8 may be further stabilized by anchoring the display to a wall using modified walls 14 incorporating anchors 16.

Figure 6:
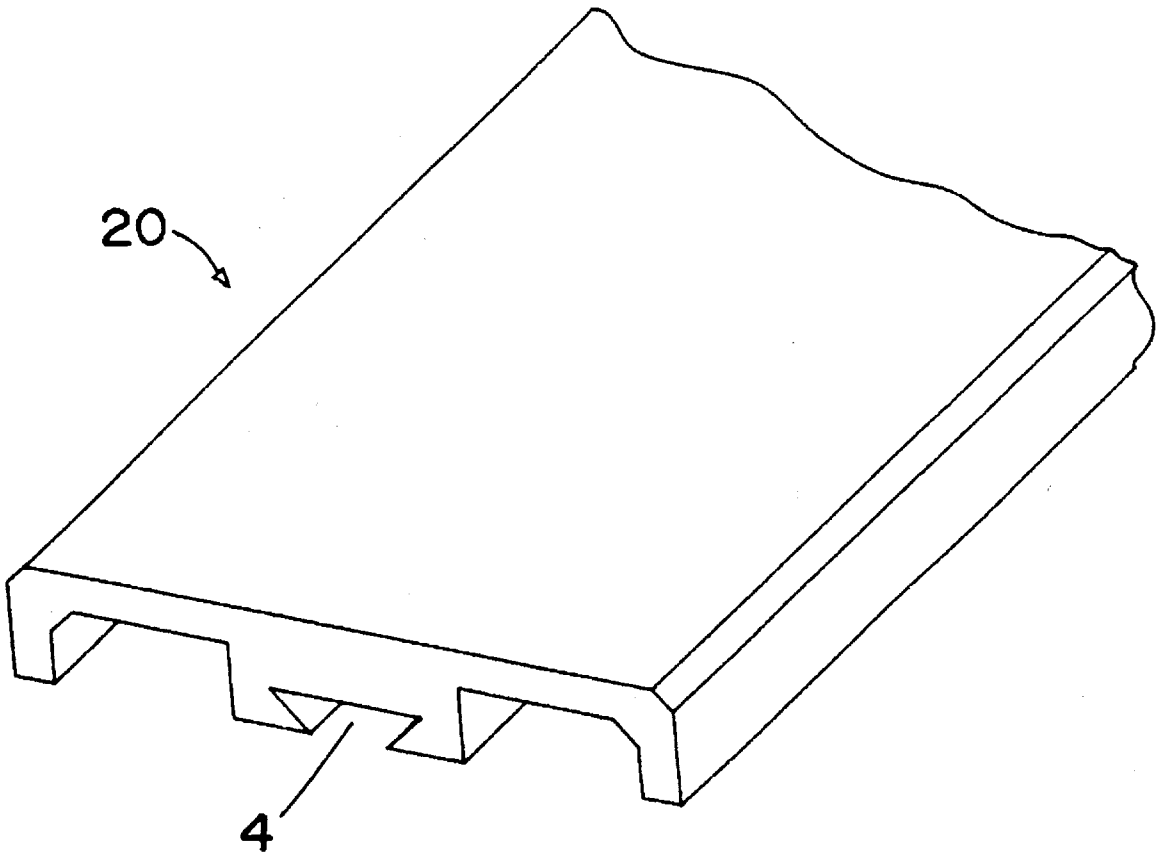
FIG. 6 is, in plan view, a decorative end plate which may be mounted to the bin of FIG. 1.

As illustrated in FIG. 6, the present invention also provides that a decorative end plate 20 may be mounted on the sides or rear surfaces of bins 2 which form merchandising display 8 so as to provide an aesthetically pleasing finish. End plates 20 are affixed to the sides of bins 2 or rear surfaces of bins 2 again by aligning vertically channel 4 on end plate 20 with vertical channels 4 on the surface which is desired to be covered and inserting in adjacent channels 4 jointer rail 10 in the same fashion by which bins 2 may be interlocked.

Figure 7:
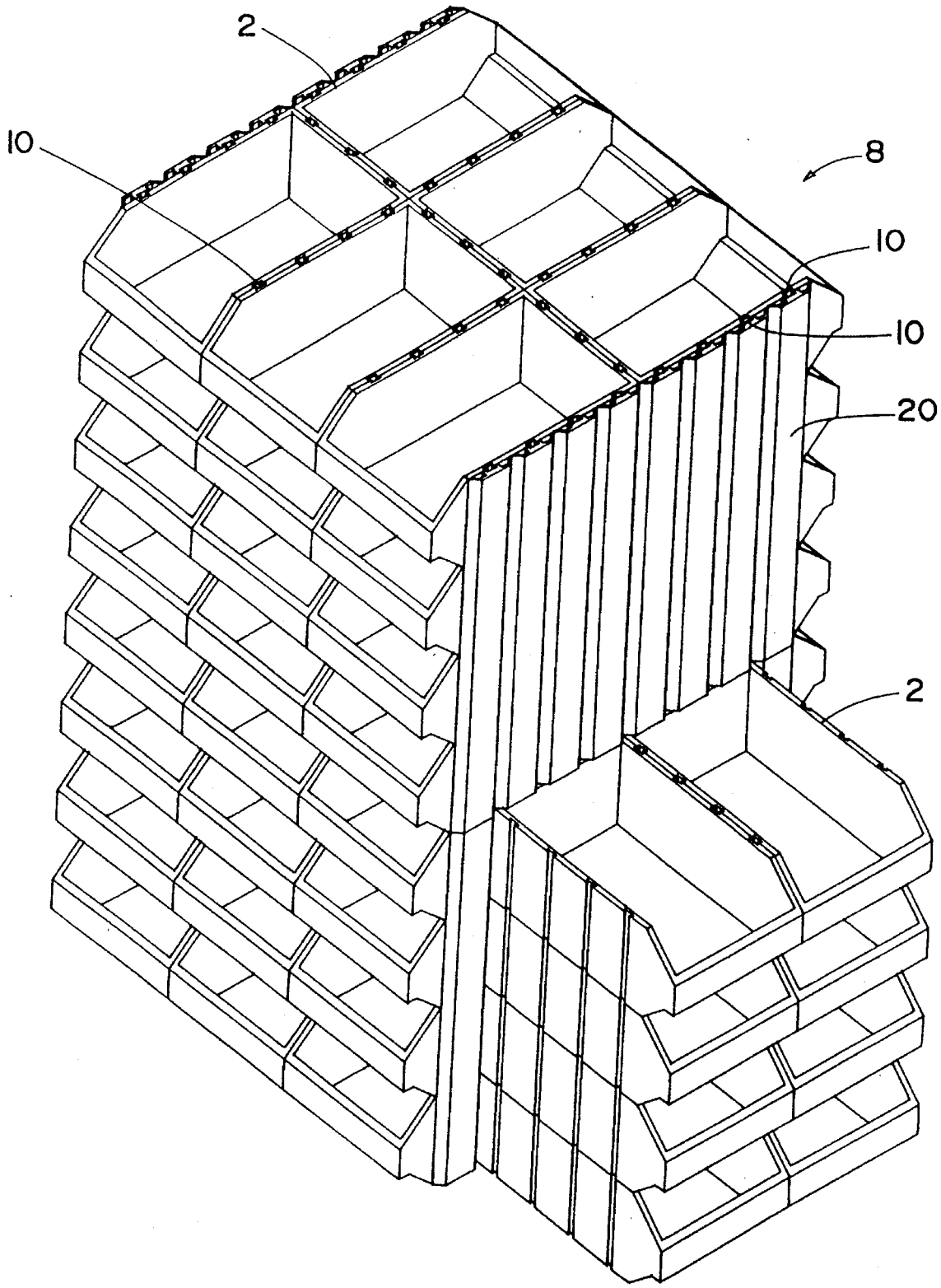
FIG. 7 is a front perspective view of a further variation of the merchandising display of FIG. 2.

FIG. 7 illustrates how bins 2 may be arranged and interlocked to form a display which displays goods from four sides in a carousel arrangement.

As will be apparent to those skilled in the art in the light of the foregoing disclosure, many alterations and modifications are possible in the practice of this invention without departing from the spirit or scope thereof. In particular, it is apparent that other than a dove-tail shape may be employed for the rails and vertical channels so long as the rails may be inserted longitudinally into two adjacently placed vertical channels so as to adjacently lock two adjacent bins against one another. Further, it may be seen that bins 2 may be modified in shape for example to provide front loading upwardly sloping shelves for merchandising boxes of screws or the like, or for example to provide front loading drawers for small loose articles such as small fasteners or the like. Such modification would not detract from the manner, described herein, for locking together adjacent bins.

Accordingly, the scope of the invention is to be construed in accordance with the substance defined by the following claims.

What is claimed is:

1. A front-loading interlocking modular merchandising display comprises:

first and second bins each having a top and a bottom, and each having front, rear and side surfaces, said front surfaces each having an opening therein, said side and rear surfaces each having at least one vertical groove on each of said surfaces, said at least one vertical groove extending vertically and continuously from said top to said bottom, whereby corresponding said at least one vertical grooves on said first and second bins are vertically aligned when said first bin is stacked on top of said second bin in vertical columnar relation, and whereby corresponding said at least one vertical grooves on said first and second bins are laterally aligned when said first bin is placed beside said second bin so as to place said side surfaces on each bin in adjacent side-by-side relation, a rail for snug removable sliding engagement within said at least one vertical groove, said rail having, in cross-section, opposed ends wider than a middle section of said cross-section, wherein each of said at least one vertical groove has a front aperture and a recessed cavity behind said aperture for receiving one of said opposed ends of said cross-section of said rail, said recessed cavity wider in cross-section than said front aperture, said rail for lateral interlocking mating engagement of said first and second bins when first and second bins are in said adjacent side-by-side relation, said rail for vertical interlocking mating engagement of said first and second bins when said bins are stacked in said vertical columnar relation, said rail removably slidable along the entire length of said corresponding said at least one vertical grooves on said first and second bins when said first and seconds bins are in said vertical columnar relation, whereby a first column of said first and second bins may be laterally releasably mated to a second column of said first and second bins when said second column is placed in adjacent side-by-side relation to said first column.

* * * * *